US007845745B2

(12) United States Patent
Görz et al.

(10) Patent No.: US 7,845,745 B2
(45) Date of Patent: Dec. 7, 2010

(54) MULTIPART DOMESTIC APPLIANCE

(75) Inventors: Alexander Görz, Aalen (DE); Philipp Reitz, Giengen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 478 days.

(21) Appl. No.: 11/919,722

(22) PCT Filed: Apr. 5, 2006

(86) PCT No.: PCT/EP2006/061330

§ 371 (c)(1),
(2), (4) Date: Oct. 30, 2007

(87) PCT Pub. No.: WO2006/120090

PCT Pub. Date: Nov. 16, 2006

(65) Prior Publication Data

US 2009/0077996 A1 Mar. 26, 2009

(30) Foreign Application Priority Data

May 10, 2005 (DE) ..... 10 2005 021 608

(51) Int. Cl.
*A47B 96/04* (2006.01)
*A47B 53/00* (2006.01)

(52) U.S. Cl. ..... 312/401; 312/198

(58) Field of Classification Search ..... 312/107–111, 312/198–203, 401, 405, 291, 293.1–293.3
See application file for complete search history.

(56) References Cited

U.S. PATENT DOCUMENTS 1,440,948 A * 1/1923 Aiken ..... 109/49
1,517,205 A * 11/1924 Flagg ..... 16/384
2,620,220 A * 12/1952 Gresham ..... 296/24.44
3,055,723 A * 9/1962 Hildebrand, Sr. ..... 312/200
3,113,358 A * 12/1963 Zell et al. ..... 312/263
3,197,265 A * 7/1965 Rand ..... 312/140.1
3,269,788 A * 8/1966 Kneer ..... 312/200
3,877,764 A * 4/1975 Hillier, Jr. ..... 312/107
3,905,662 A * 9/1975 Richmond ..... 312/249.8
4,423,687 A * 1/1984 Serra ..... 109/50
5,447,366 A * 9/1995 Cole ..... 312/50
5,749,636 A * 5/1998 Boury ..... 312/201

(Continued)

FOREIGN PATENT DOCUMENTS

DE 296 08 432 U1 8/1996

(Continued)

OTHER PUBLICATIONS

International Search Report PCT/EP2006/061330.

*Primary Examiner*—Darnell M Jayne
*Assistant Examiner*—Timothy M Ayres
(74) *Attorney, Agent, or Firm*—James E. Howard; Andre Pallapies

(57) ABSTRACT

The invention relates to a domestic appliance that includes a first and a second housing that are juxtaposed and fastened to each other sidewall to sidewall. A hinge hinging one housing to the other housing is fastened to respective edges of the sidewalls of the housings facing each other. A blocking element is fastened to the housings at a distance to the respective edges of the sidewalls and blocks the freedom of motion of the hinge.

13 Claims, 3 Drawing Sheets

U.S. PATENT DOCUMENTS

Figure 1:
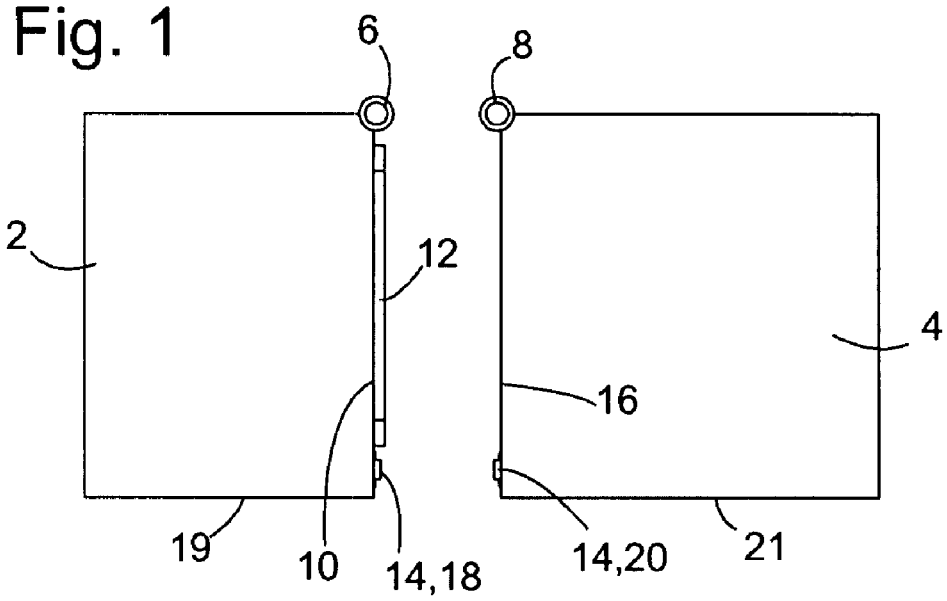

| | | | | |
|---|---|---|---|---|
| 5,921,095 | A | 7/1999 | Lee et al. | |
| 7,004,436 | B2 * | 2/2006 | Knapp | 248/220.22 |

FOREIGN PATENT DOCUMENTS

| | | |
|---|---|---|
| DE | 202 09 516 U1 | 10/2003 |
| FR | 2.206.485 | 6/1974 |
| JP | 3110369 | 5/1991 |
| WO | WO 96/07063 | 3/1996 |
| WO | WO 04/001305 | 12/2003 |

* cited by examiner

MULTIPART DOMESTIC APPLIANCE

The present invention relates to a domestic appliance with a first and a second housing, which are arranged with their sidewalls adjacent to each other and are fastened to each other (side-by-side arrangement).

Side-by-side arrangements of domestic appliances have long been known. Electrical appliances and kitchen furniture are manufactured nowadays so that they are able to be joined together, built in and combined to guarantee a smooth workflow in the kitchen area. This building-block concept additionally gives the manufacturer the opportunity of being able to satisfy the customer's individual design requirements at no extra cost.

The current particular favorite is side-by-side-arrangement of a refrigerator and a freezer. This reflects the increasingly changing shopping, cooking and eating habits prevailing in kitchen design. This means that numerous finished products which must be stored in various refrigeration zones are purchased in few shopping trips.

DE 202 09 516 U1 discloses a refrigerator and freezer appliance of this type, consisting of a square refrigerator part and a freezer part which can be set up side-by-side into from one unit. An airtight seal seals-off the space between the two units. This prevents moisture-laden air, which is cooler by comparison with the surrounding air, entering the space between the refrigerator and freezer part in which the moisture condenses on the side surfaces of the refrigerator and freezer part. Attachment rails are attached to the front to prevent the appliances moving apart from each other.

In this layout however it can occur that, because of careless movement during or after the setting up of the appliances, the gap between the wall surfaces facing each other widens out towards the rear of the refrigeration appliance and thus renders the surrounding seal ineffective. In addition it has been shown that in difficult installation situations when the housing is being moved into the "required position" the sensitive seals can be damaged.

The object of the invention is to create a domestic appliance which features two housings with sidewalls facing each other, in which the housings are able to be installed in a simple manner and form a structure which is stable in its shape once installed.

The object is achieved in accordance with claim 1 by attaching to one edge of the sidewalls of the housing facing each other in each case a hinge which forms a hinged connection for the housings and by attaching to the housings at a distance from this edge a connection element which blocks the freedom of movement of the hinge. The hinge makes it possible to join the housings by a rotational movement and thus simplifies the installation of the housing on site since the attachment of the housings to each other can be undertaken in a first step without the housings having to be aligned completely in parallel to one another. This significantly shortens the installation time since, as a result of the weight and the size of the housings, the tedious and tiring "moving backwards and forwards" of the housings until they are aligned flush with each other at the front and at the back is dispensed with entirely.

In this case the hinge parts can be connected at any angle. The pivoting movement defined precisely by the hinge prevents the seal being damaged when the devices are joined together. It is slowly compressed in protective manner as the gap is closed. The blocking connection element prevents the housings moving apart after installation so that the surrounding seal can have its full effect.

To make easy access to the hinges possible and thus a simple installation of the hinges on site and at the same time to avoid disruptive elements in the area of the housings visible to the customer after installation the hinge is accommodated at the rear edge of the sidewalls facing each other In this case it is especially advantageous for a recess to be formed at a corner of each housing at which the facing sidewalls and a rear wall of each housing meet and for the axis of the hinge to run in the recess. This embodiment variant prevents the hinge protruding beyond the rear wall of the housing and forming a projection which would get in the way if the domestic appliance were installed against a wall or were mounted in a frame provided for it.

Preferably the hinge, as the connecting joint between the housing parts, consists in each case of a part attached to the first and the second housing respectively, with the parts engaging to form a close fit in the direction of the pivot axis of the hinge.

To obtain a stable hanging of the hinges on the housings, in a preferred embodiment the hinge includes a part attached to the first or second housing respectively, with the parts being attached to cover a corner of first or second housing respectively.

So that the hinge parts can be manufactured in large volumes and thereby at low cost, the hinge includes a part attached to the first or second housing which is formed identically. The hinge parts are shaped so that they engage with each other and that there is a close fit between the parts in the direction of the pivot axis of the hinge, to make possible a transmission of vertical forces from one housing to the other. In addition the installation effort is reduced if only a few different installation parts are need for installation of the domestic appliance.

The installation concept is developed in a preferred embodiment of the invention by the hinge featuring a removable pivot pin. After the housings have been brought together in the appropriate manner and the hinge parts engage with each other, the pivot pin is simply pushed through the hinge parts to form the pivot axis.

Inventively the joining element, which is accommodated at some distance from the hinge on the housings described above in their edge area is provided with two brackets each attached to one of the two facing sidewalls and together delimiting a locking channel. It also includes a bolt which fits into the locking channel.

In this case it is useful for there to be close fit between the interlocking brackets, just as with the hinge parts in the direction of the pivot axis of the hinge, so that a force due to weight can be transmitted via the brackets and the two housing parts can be lifted from one side as a unit in order to move them.

In a preferred embodiment of the invention the bolt has an angled end section which is supported on one of the brackets when the bolt is inserted into the locking channel. The angled end section represents a safeguard of the connection element which prevents the inserted bolt from sliding right through the locking channel.

It is useful for the end section to be supported against the bracket on just a part of its width. This ensures that when the housing is taken apart with a screwdriver or similar tool, the tool can be fitted under the part of the bolt not supported on the bracket to pull the bolt out of the locking channel and thus release the lock.

As an alternative to the preferred embodiment a screw thread is embodied in the supported end section. By screwing an appropriate screw into the thread which then presses against the bracket, the bolt can be pulled out of the locking channel.

The inventive domestic appliance is especially embodied as a refrigerator and has a seal between the sidewalls for sealing the gap and preventing the buildup of condensation.

To hide this seal from view there is provision in accordance with the invention for the gap between the facing sidewalls to be hidden at least on the front side of the appliance by a profiled cover.

Figure 2:
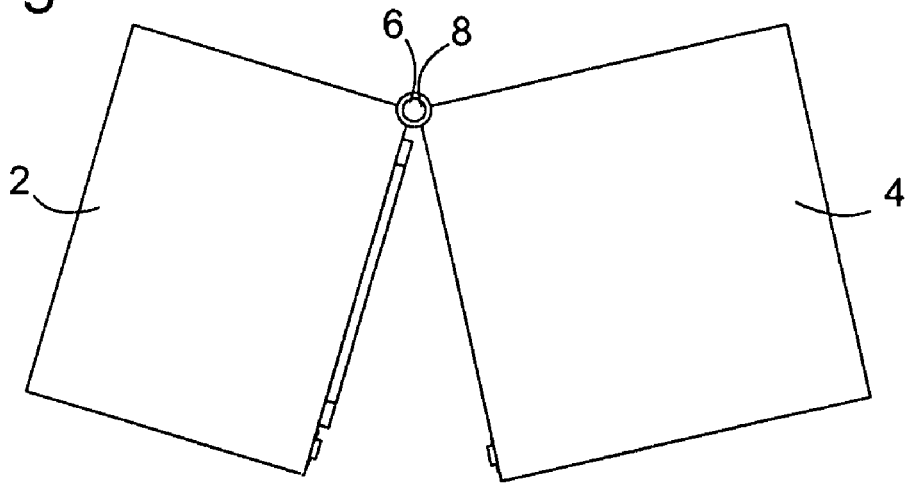
Figure 3:
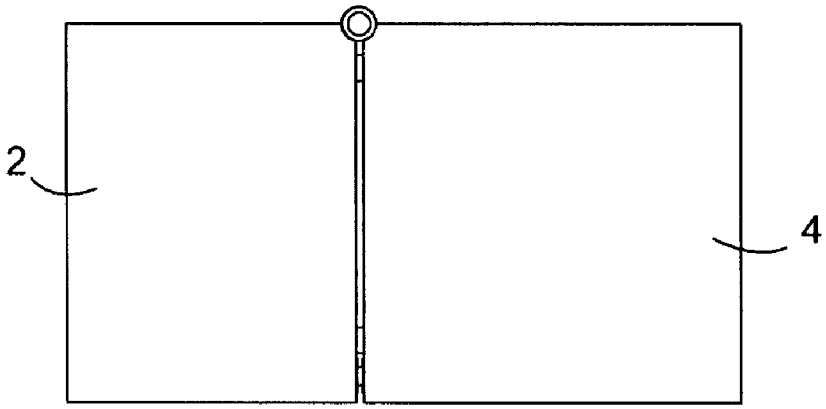
Figure 4:
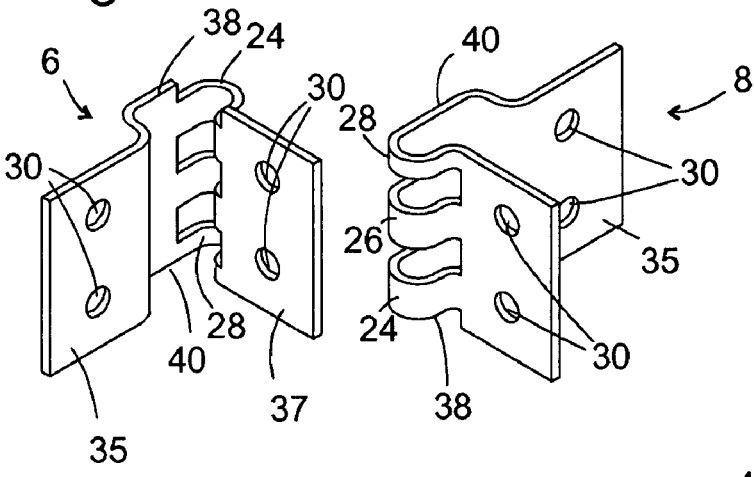
Figure 5:
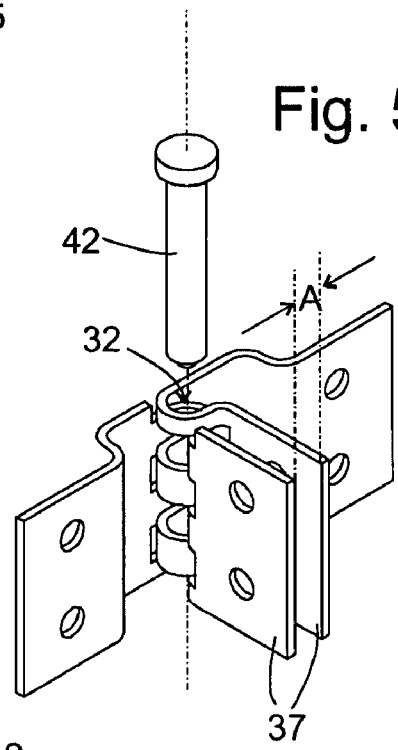
Figure 6:
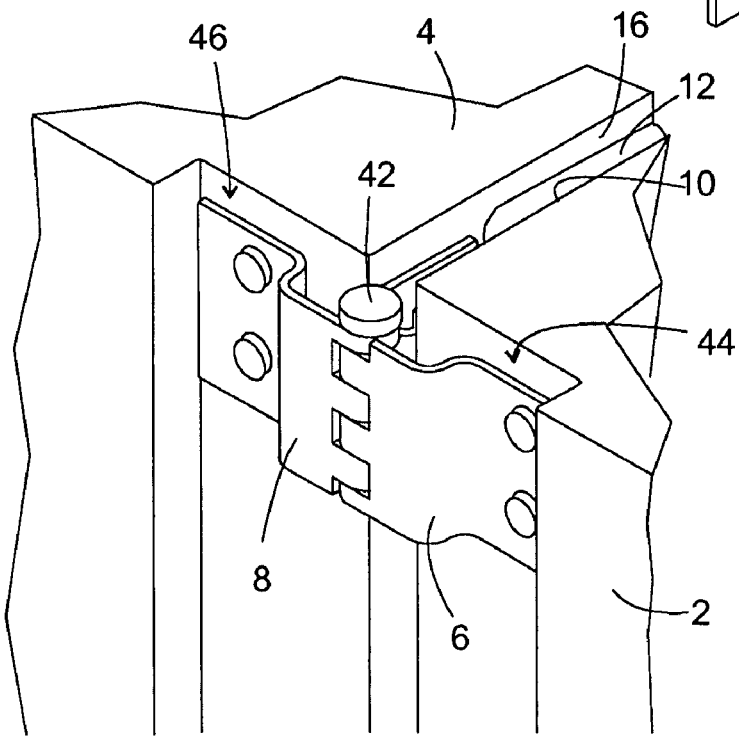
Figure 7:
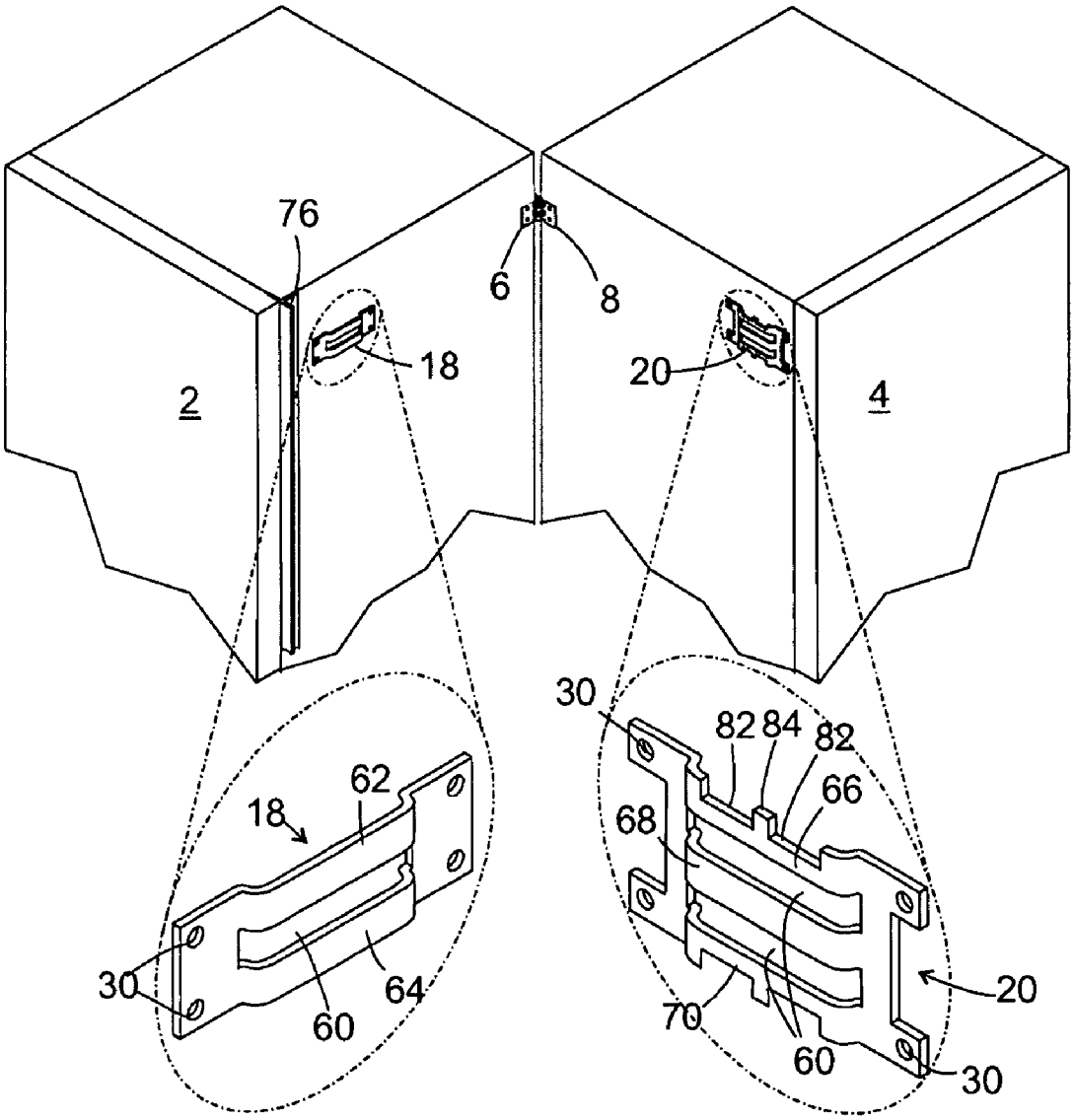
Figure 8:
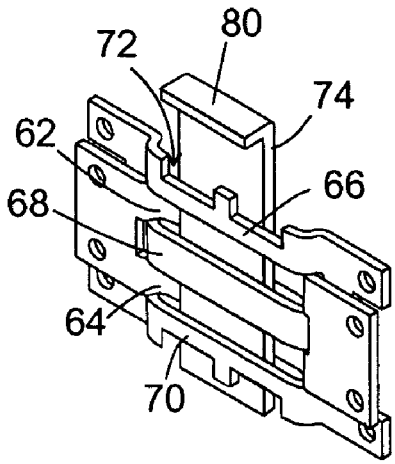

The description given below serves in conjunction with the drawing to explain the invention. The figures show:

FIG. 1 a view of the inventive domestic appliance from above with a first and second housing before the start of installation FIG. 2 a view from above of the inventive domestic appliance during installation FIG. 3 a view from above of the fully installed inventive domestic appliance FIG. 4 a perspective diagram of the hinge parts of the inventive domestic appliance FIG. 5 a perspective diagram of the closely fitting hinge parts with the pivot pin at the point when the pivot pin is being inserted into the hinge FIG. 6 a perspective diagram of the rear of the fully installed inventive domestic appliance FIG. 7 a perspective diagram of the inventive domestic appliance with the connecting element during installation FIG. 8 a perspective diagram of the connecting element with the two brackets and the bolt engaging with them FIG. 1 is a view down onto the upper side of the two housings 2, 4 of a side-by-side arrangement of the inventive domestic appliance. The housing 2 can for example be that of a refrigerator while the housing 4 belongs to a freezer. The hinge parts 6 and 8 can also be seen in the figure, arranged in a corner area of the housings 2 and 4 respectively. Glued to the side wall 10 of the housing 2 is a frame made from a flexible profiled cover 12. A connecting element 14 is attached to the sidewalls 10 and 16 of the housing parts 2 and 4 in the vicinity of the front sides 19 and 21 of the housing parts 2 and 4 and comprises two brackets 18 and 20.

In FIG. 1 the housings 2 and 4 are positioned at their intended installation location—in a kitchen area for example—not joined to each other.

FIGS. 2 and 3 again shown the housing parts 2 and 4 in view from above. FIGS. 2 and 3 show in two different setup stages the execution sequence of an installation process as is only possible in the present invention.

Conventionally the two housing parts would be pushed together until their facing sidewalls were aligned in parallel and their front sides were flush with each other in order to form a flat front area. In such case it was not uncommon for the seal to be damaged even during installation by an uneven movement of the heavy housings. Especially when the touching housings were moved in parallel to their sidewalls facing each other, frictional forces often occurred between the sidewall of the housing without sealing frame and the side of the housing equipped with sealing frame which destroyed the seal. If this defect was not discovered in good time and the seal renewed, an airtight seal from the gap between the housings could no longer be provided, so that condensation-laden air entered the gap area between fridge and freezer part which condensed on the side surfaces of the fridge and freezer part. Careless movement during or after the setting up of the domestic appliances also caused the gap between wall surfaces facing each other to widen out towards the rear of the refrigeration appliance and the surrounding seal was thus rendered ineffective.

By contrast, in the present invention the rear corners of the housings 2, 4 carrying the hinge parts 6,8 are first placed in relation to each other so that the hinge parts 6,8 engage with each other and can be connected in a way explained in more detail below. The connected hinge parts 6,8 now define a pivot axis around which the sidewalls of the housings 2, 4 can be hinged in relation to each other and in doing so compress the sealing profile 12. FIG. 3 shows the final positions of the housings 2,4 alongside each other.

For better understanding of the setup and the installation of the side-by-side appliances 2 and 4, FIG. 4 shows a perspective view of the hinge parts 6 and 8 on the rear edge of the facing sidewalls 10 from FIG. 1 in an enlarged perspective view.

The hinge parts 6 and 8 are identical one-piece sheet metal parts. They each have two attachment arms 35 and 37 with two screw holes 30 in each case and a curved center section 22 joining the attachment arms in which three hoops 24, 26 and 28 are separated from each other by horizontal slots. The attachment arms 35 and 37 of hinge parts 6 or 8 are at right angles to each other to allow one to be attached to a sidewall and the other to a rear wall of the housing 2 or 4 respectively. The hinge section 6 is rotated and positioned by comparison with hinge section 8 so that a side edge labeled 38 which is aligned upwards with hinge part 6, points downwards with hinge part 8, and the opposite applies for a side edge 40.

In the perspective diagram shown in FIG. 5 the hoops 24, 26 and 28 of the hinge parts 6 and 8 form a close fit into each other and thus form a cylindrical cavity 32. This is intended to accommodate a pivot pin 42 which holds the hinge parts 6, 8 together to allow them to pivot. The hinge parts 6 and 8 are formed so that the attachment arms 37 which are designed for attaching the hinge parts 6 and 8 to the facing sidewalls 10, 16 of the housing 2, 4 have a distance A between them which is somewhat smaller than the thickness of the sealing profile 12 when the hinge tabs 6 and 8 engage with each other.

FIG. 6 shows the fully installed housing 2 and 4 viewed from the rear. The hinge parts 6 and 8 are each accommodated in a recess 44, 46 between side and rear wall of the housing 2, 4, so that they do not protrude beyond the rear wall of the housing. The pivot pins 42 and hinge parts 6 and 8 are joined to form the completed hinge. The seal 12 lies pressed together against the relevant sidewalls of the housings 10 and 16. In this way the space between the housings will be sealed off by an airtight seal.

As already mentioned in relation to FIG. 1, a connecting element 14 with two brackets 18, 20 is accommodated in the front area of the sidewalls 10, 16 of the housing 2, and this will now be explained in more detail in relation to FIGS. 7 and 8.

FIG. 7 shows a perspective diagram of the two housings 2, 4 in the state shown in FIG. 2 where they are joined by the hinge, in which the sidewalls 10, 16 are not close together.

The brackets 18, 20 made of metal each have two attachment flanges with holes 30, used for screwing them to the sidewalls 10, 16 and which are connected by two curved-out ribs 62 and 64 in the case of the bracket 18 or three ribs 66, 68 and 70 in the case of the bracket 20. The width of the cutouts 60 between the ribs of a bracket 18 o. 20 is selected so that the ribs of the other bracket in each case can engage into it when the walls 10, 16 are in the position shown in FIG. 3.

The brackets 18, 20 are placed on the walls 10, 16 so that the ribs 62, 64, 66, 68, 70 engage with each other if by pivoting in the hinge the walls 10, 16 are moved towards each other and the profiled seal 12 between them is pressed together. As shown in FIG. 8, the engagement of the ribs 62, 64, 66, 68, 70 produces a locking channel 72 between them into which a bolt 74 is inserted to prevent the housings 2, 4 moving apart again.

It can be seen from FIG. 8 that the bolt 74 has an angled end section 80 which comes to rest against the upward projection 84 between cutouts 82 on the upper edge of the rib 66 and thus protects the inserted bolt from being shaken through the locking channel 72. This ensures that when the housing is dismantled a screwdriver or similar tool can be inserted into the cutouts 82 to catch the end section 80 and pull the bolt 74 out of the locking channel 72 and thus release the bolt.

Alternatively the end section could be provided with a threaded hole which ends at the upper edge of the rib 66. When a screw is inserted into this threaded hole and hits the upper edge of the rib 66 it presses the end section 80 upwards and thus gradually pushes the bolt 72 out of the locking channel 74. In this way it is even possible to release the bolt if it is jammed in the channel 72.

A flexible T-profile 76 made from plastic shown in FIG. 7 is only inserted into the space between the walls 10, 16 after the brackets 18, 20 have been locked in order to hide the connecting element 14 and the seal 12.

The invention claimed is:

1. An appliance comprising:

a.) a first housing that houses a component which performs an electrical appliance function, the first housing having a side wall and an access location on a front wall other than the side wall at which access to the appliance function-performing component can be had;

b.) a second housing that houses a component which performs an electrical appliance function, the second housing having a side wall and an access location on a front wall other than the side wall at which access to the appliance function-performing component can be had, the first housing and the second housing being disposable in a user configuration in which the side wall of the first housing is adjacent to the side wall of the second housing yet access to the respective appliance function-performing components of the first housing and the second housing can still be had;

c.) a hinge hingedly interconnecting the first housing and the second housing to each other for pivoting movement of one housing relative to the other housing, the hinge having a first portion connected to the first housing, a second portion connected to the second housing, and means interconnecting the first portion of the hinge and the second portion of the hinge to one another for pivotal movement, wherein the hinge is attached to a rear edge of the sidewalls facing each other; and d.) a blocking element for selectively blocking pivotal movement of the hinge such that the side wall of the first housing is maintained adjacent to the side wall of the second housing in the user configuration.

2. The appliance as claimed in claim 1, wherein the sidewalls of the first housing and the second housing face each other and each of the first housing and the second housing has a rear wall and, at a corner of the first housing formed by its sidewall and its rear wall that is adjacent to a corner of the second housing formed by its sidewall and its rear wall, a recess is formed in each one of these adjacent corners of the first housing and the second housing, and the hinge has a pivot axis extending through the recess.

3. The appliance as claimed in claim 2, wherein the first portion of the hinge and the second portion of the hinge engage to form a close fit with each other in the direction of the pivot axis of the hinge.

4. The appliance as claimed in claim 1, wherein the first portion of the hinge and the second portion of the hinge are attached to cover a respective corner one of the first housing and the second housing.

5. The appliance as claimed in claim 2, wherein the first portion of the hinge and the second portion of the hinge are identical in shape and between as claimed in claim 1, wherein the first portion of the hinge and the second portion of the hinge are there is a close fit in the direction of the pivot axis of the hinge.

6. The appliance as claimed in claim 1, wherein the hinge includes a removable pivot bolt.

7. The appliance as claimed in claim 1, wherein the blocking element has two brackets one of which is attached to a respective one of the sidewalls of the first housing and the second housing, the brackets together delimit a locking channel and the blocking element includes a bolt that engages in the locking channel.

8. The appliance as claimed in claim 7, wherein is a tight fit between the brackets in the direction of a pivot axis of the hinge.

9. The appliance as claimed in claim 7, wherein the bolt has an angled end section supported on one of the brackets when the bolt is introduced into the locking channel.

10. The appliance as claimed in claim 9, wherein the angled end section is only supported against the bracket over part of its width.

11. The appliance as claimed in claim 9 and further comprising a screw thread is formed in the end section.

12. The appliance as claimed in claim 1 and further comprising a seal inserted between the sidewalls of the first housing and the second housing.

13. The appliance as claimed in claim 1 and further comprising a gap between the sidewalls of the first housing and the second housing that is concealed on at least on a front side of the appliance by a profiled cover.

* * * * *